US007931855B2

(12) United States Patent
Berglund et al.

(10) Patent No.: US 7,931,855 B2
(45) Date of Patent: Apr. 26, 2011

(54) METHOD OF CONTROLLING THE OXYGEN CONTENT OF A POWDER

(76) Inventors: Roger Berglund, Vasteras (SE); Hans Eriksson, Vasteras (SE); Johan Sundstrom, Stockholm (SE); Per Arvidsson, Kvicksund (SE)

( * ) Notice: Subject to any disclaimer, the term of this patent is extended or adjusted under 35 U.S.C. 154(b) by 202 days.

(21) Appl. No.: 11/576,746

(22) PCT Filed: Oct. 6, 2005

(86) PCT No.: PCT/SE2005/001486
§ 371 (c)(1),
(2), (4) Date: Jun. 23, 2008

(87) PCT Pub. No.: WO2006/038878
PCT Pub. Date: Apr. 13, 2006

(65) Prior Publication Data

US 2008/0268275 A1 Oct. 30, 2008

(30) Foreign Application Priority Data

Oct. 7, 2004 (SE) ..... 0402439

(51) Int. Cl.
*B22F 3/10* (2006.01)
*B22F 9/00* (2006.01)

(52) U.S. Cl. ..... 419/58; 75/343; 75/369; 419/36; 419/37; 419/57

(58) Field of Classification Search ..... 75/343, 75/369; 419/36–37, 57, 58
See application file for complete search history.

(56) References Cited

U.S. PATENT DOCUMENTS

| | | | | |
|---|---|---|---|---|
| 3,627,521 | A | 12/1971 | Vordahl | |
| 3,992,200 | A | 11/1976 | Chandhok | |
| 4,038,738 | A | 8/1977 | Fischmeister et al. | |
| 4,178,178 | A | 12/1979 | Garvare et al. | |
| 4,292,725 | A | 10/1981 | Larsson et al. | |
| 4,722,756 | A * | 2/1988 | Hard | 148/513 |
| 4,824,481 | A | 4/1989 | Chatterjee et al. | |
| 4,964,906 | A | 10/1990 | Fife | |
| 5,328,336 | A * | 7/1994 | Nowobilski | 417/48 |
| 6,328,927 | B1 | 12/2001 | Lo et al. | |
| 6,355,211 | B1 | 3/2002 | Huang | |
| 2001/0030005 | A1 | 10/2001 | Fife | |
| 2004/0191108 | A1 | 9/2004 | Han et al. | |

FOREIGN PATENT DOCUMENTS

| | | |
|---|---|---|
| JP | 2004-300494 | 10/2004 |
| SE | 527 417 | 2/2006 |
| SU | 1770088 | 10/1992 |

* cited by examiner

*Primary Examiner* — Scott Kastler
*Assistant Examiner* — Brian Walck
(74) *Attorney, Agent, or Firm* — Dann, Dorfman, Herrell and Skillman, P.C.

(57) ABSTRACT

A method of reducing the oxygen content of a powder is provided. A canister is prepared with a getter, filled with the powder to be densified, sealed and evacuated. The canister is subjected to a hydrogen atmosphere at an elevated temperature whereby hydrogen diffuses into the canister through the walls thereof. The hydrogen forms moisture when reacted with the oxygen of the powder and the moisture in the reacted with the getter in order to remove oxygen from the powder to the getter. The atmosphere outside the canister is then altered to an inert atmosphere or vacuum, whereby hydrogen diffuses out of the canister. A dense body having a controlled amount of oxygen can thereafter be produced by conventional powder metallurgy techniques.

11 Claims, 1 Drawing Sheet

METHOD OF CONTROLLING THE OXYGEN CONTENT OF A POWDER

The present disclosure relates to a method of reducing the oxygen content of a powder, for example a metallic powder, in a controlled manner, the powder being located in an enclosed canister. The present disclosure also relates the manufacturing of dense bodies and to a dense product produced by the method. Especially it relates to a method of reducing the oxygen content of metallic powders having high chromium content and low carbon content.

BACKGROUND OF THE INVENTION AND PRIOR ART

When producing powders, especially metallic powders, there is often an unintentional oxidation of the surfaces of the powders during production. Furthermore, oxygen might be present inside the powder itself, either in solution or as oxide particles. In this latter case the oxygen is usually generated during the melting process due to equilibrium with the dross and the lining of the furnace.

The oxides, especially the oxides of the powder surfaces, might lead to deteriorated mechanical properties of a component produced to near-net-shape (NNS) of a powder by densification. In the case of surface oxides, a network of oxide inclusions will form where the surfaces of the powder were located before densification.

One example of a powder that suffers from the above stated problems is powder of super duplex stainless steels (SDSS). Dense bodies of SDSS can be used in various different environments. One application is in the oil and gas industry. However, dense bodies of SDSS produced by powder metallurgy generally suffer from low impact strength. One theory of the reason for this problem is that intermetallics precipitate at oxide inclusions. Another theory is that intermetallics and oxide precipitates both decrease the impact strength, however separately. In either case, there is a need of reduced oxygen content of the powder.

However, even other powder materials, such as metallic powders or hard materials, might have a too high content of oxygen to achieve good mechanical strength, such as impact strength, after compacted to a dense body. This is especially important for materials that easily oxidise during powder formation even if precautionary measurements have been taken.

It is previously known to utilise a getter to minimise the oxygen content when producing dense products by powder metallurgy technique. For example, U.S. Pat. No. 3,992,200 discloses the use of a getter consisting of Ti, Zr, Hf and mixtures thereof to prevent oxide formation in the final compacted article. This method is for example utilised on high-speed steels and superalloys. Furthermore, U.S. Pat. No. 6,328,927 discloses the use of a getter when manufacturing dense bodies of tungsten. In this case the powder capsule is made of the getter material, such as titanium or alloys thereof.

However, merely utilising a getter material does not sufficiently reduce the oxygen content to the desired low levels of all powders, especially of all powders of steels. This is especially difficult in powders wherein the carbon content is low, such as ≦0.1%. The time for reduction, and hence the result, is difficult to accomplish in a controlled manner and in a cost-effective way.

Consequently, there is a need for a method of reducing the oxygen content of a powder in a controlled manner before densification, especially for low oxygen contents.

Also, there is a need for reducing the oxygen content of low carbon steels, having a high Cr content, to very low levels, such as less than 100 ppm.

SUMMARY OF THE INVENTION

A method of reducing the oxygen content of a powder is provided. A canister is prepared with a getter, filled with the powder to be densified, evacuated and sealed. The canister is subjected to a hydrogen atmosphere at a temperature of 900-1200° C., which results in a diffusion of hydrogen into the canister through the walls thereof. The hydrogen forms moisture when reacted with the oxygen of the powder and the moisture in then reacted with the getter in order to remove oxygen from the powder to the getter. The atmosphere outside the canister is then altered to an inert atmosphere or vacuum, whereby hydrogen diffuses out of the canister.

The powder having a reduced oxygen content can thereafter be subjected to conventional near-net-shaping powder metallurgy technologies, such as Hot Isostatic Pressure (HIP) or Cold Isostatic Pressure (CIP), whereby a dense product having a controlled content of oxide inclusions is accomplished.

DETAILED DESCRIPTION OF THE INVENTION

Figure 1:
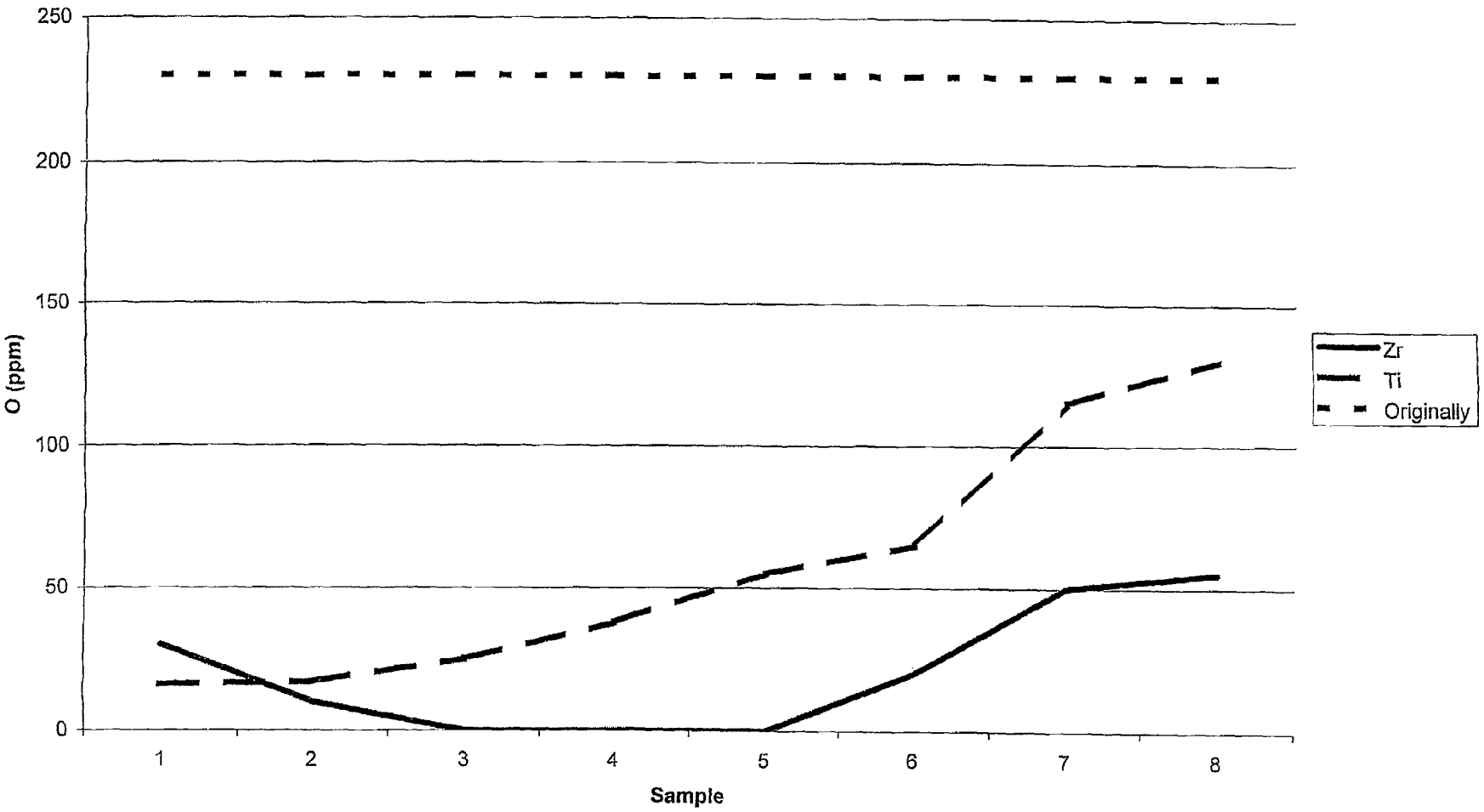
FIG. 1 shows the oxygen content profile of a densified body of stainless steel.

The problems stated above have now been solved by a new method utilising selective hydrogen diffusion through the walls of the canister in combination with a getter to achieve a controlled reduction of oxygen inside an enclosed canister.

Firstly, a canister, preferably of a mild steel, is provided with a getter material. The getter material can be introduced into the canister for example by providing the canister walls with a thin foil of the getter material. However, any method of introduction of the getter material into the canister may be utilised, such as for example forming the canister of the getter material. The getter is preferably selected from the group of Ti, Zr, Hf, Ta, REM or an alloy or compound based on any of these elements. More preferably, the getter is Ti or Zr. It is important that the getter has such a high melting temperature that it does not melt during the procedure and that it is distributed so that the distance for diffusion to the getter is not too long. Preferably, the getter is distributed along at least the longest wall of the canister, more preferably the getter is distributed along all of the canister walls.

In some cases it might be desirable to produce a dense body wherein different parts of the body have different properties. In such a case, the getter is naturally placed in the canister at locations where a lower oxygen content of the final product is desired. This might for example be applicable when producing larger dense bodies, since the distance of diffusion to the getter might be very long.

Thereafter, the canister is filled with a powder. This is the powder, which should be reduced in oxygen content and thereafter densified to near-net-shape (NNS) by conventional powder metallurgy techniques, such as HIP or CIP. The canister is thereafter evacuated and sealed according to conventional procedure.

The canister is heated up to a temperature of 900-1200° C. in a hydrogen atmosphere. Preferably the canister is heated up to a temperature of 1000-1150° C. By subjecting the canister to this heat treatment, hydrogen is allowed to diffuse into the canister through the walls thereof. Preferably, the heating is performed at a rate of 0.5-5° C./min, more preferred at a rate of 1-3° C./min. Both the heating rate and the temperature are preferably adjusted to the powder material and naturally also the desired result. The hydrogen will diffuse into the canister until the hydrogen partial pressure on both sides of the walls of the canister has been substantially equilibrated, which means approximately 1 bar inside the canister. Hydrogen and oxide of the powder will react and thereby establishing a moisture partial pressure inside the canister.

The reduction of oxygen is performed by the moisture inside the canister reacting with the getter material according to the following formula:

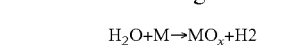

$$H_2O+M \rightarrow MO_x+H2$$

wherein M is the getter material or the active part thereof. Thereby, oxygen is transferred from the powder bulk to the getter.

Reduction of the oxygen content of the powder may be performed during the heating process. However, it can also be performed during a holding time at a constant temperature or a stepwise increasing temperature using a holding time at each temperature step.

The time for oxygen reduction with aid of the heat treatment described above is adjusted to the powder material, the size of the canister, i.e. the amount of powder, and the oxygen level to be achieved. Furthermore, the time may in some cases preferably be adapted to the selected getter material. Preferably, in the cases wherein holding times are used, the total time for reduction is at least one hour, more preferably 3-15 hours, and most preferably 5-10 hours. However, the total reduction time must be adapted to temperature as well as the size of the canister, i.e. the maximum distance of diffusion of oxygen and/or moisture to the getter.

After the reduction of oxygen is performed, the environment outside the canister is altered to an inert atmosphere or vacuum. Preferably, the inert atmosphere is accomplished by flowing gas, such as Ar or $N_2$. The hydrogen will as a result of the altered environment diffuse out of the canister trough the walls thereof in order to establish substantially a state of equilibrium between the inside and the outside of the canister, i.e. the partial pressure of hydrogen inside the canister is approximately zero.

The canister is after the diffusion of hydrogen in and out of the canister optionally allowed to cool down to room temperature. Preferably, this cooling procedure is slow. It may be performed at the same time as the canister is subjected to the inert atmosphere in order to diffuse hydrogen out of the canister. However, according to a preferred embodiment of the invention, the densifying process, such as for example HIP, is performed while the canister is still hot, i.e. the densifying process is performed directly after the diffusion of hydrogen in and out of the canister.

The powder is then ready to be densified by conventional powder metallurgy techniques, such as HIP or CIP, to a near net shape. Additionally, the above-described method can also be used when attaching densified powders to a substrate.

Parameters that are considered to influence the result of the above-described method are time to fill the canister with hydrogen, temperature and time for the reduction of oxygen and time to evacuate hydrogen from the canister after the reduction. Naturally, all parameters must be adjusted to the composition of the powder material and the result to be achieved.

The time to fill the canister is naturally affected by the thickness of the canister walls as well as temperature. In some cases it might be applicable to provide a canister that has some parts of the walls that facilitates the diffusion of hydrogen as well. This can be accomplished for example by providing thinner canister walls at those parts or select a different material with a higher diffusivity of hydrogen for those parts of the canister walls. On the other way around, some parts of the walls might need to be thicker in order to resist dimensional distortion due to thermal softening.

By utilisation of the method, the oxygen level of the powder can be reduced in a controlled manner at least to levels below 100 ppm. This results in that a dense body can be manufactured, which has good mechanical properties, especially good impact strength and a low ductile-to-brittle-temperature.

One advantage of the method described above is that the presence of hydrogen gas inside the canister increases the heating rate compared to if it would be a vacuum inside the canister. This is due to that the hydrogen conducts heat better than a vacuum does. Another advantage of the method is that the nitrogen content of the powder after the oxygen reduction is substantially the same as in the originally provided powder. Consequently, the method is advantageously used on powders wherein the nitrogen content is important for the properties.

Moreover, another advantage is that the method enables the use of powders, which would not be able to use before due to too high oxygen content. For example, powders produced by water-atomisation can be used for production of dense products instead of more expensive inert gas atomised powders, while still achieving good properties. Consequently, cheaper materials can be used resulting in a more cost-effective final dense product.

Furthermore, a person skilled in the art realises that the method described above also generates a bonus effect since oxidation of the canister walls is inhibited, especially the outside of the canister walls. Thereby, the risk for the canister to leak during for example a subsequent HIP process is minimised. Furthermore, the risk for damage or wear out of certain furnaces, such as graphite or Mo furnaces, due to oxides on the canisters is reduced.

The method according to the present disclosure is particularly developed to be used for powder materials of stainless steels, especially super duplex stainless steels (SSDS) and 316L. However, it is also possible to utilise this method on other powder materials when the content of oxygen has to be reduced and also when producing hard materials.

Optionally, the reduction of oxygen inside the canister can further be promoted by the usage of additional reducing agents above the hydrogen. Such reducing agents are preferably carbon based. The carbon might be introduced by for example providing a carbon surface on the powder, mixing graphite with the powder or even utilising the carbon content of the powder itself. In this case it is important that the getter also may reduce the carbon content. Therefore, suitable materials as getters are in this case Ti, Zr or Ta.

The present disclosure will now be described in more detail with the aid of some illustrative examples.

EXAMPLE 1

Two powders produced by nitrogen-gas atomisation were tested. The composition of the powders are listed in Table 1, all in weight percent except oxygen which is in parts per million.

TABLE 1

| Alloy | Cr | Ni | Mo | Mn | Si | Cu | C | N | O ppm |
|---|---|---|---|---|---|---|---|---|---|
| 1 | 26.2 | 6.2 | 3.0 | 0.58 | 0.54 | 1.8 | 0.039 | 0.3 | 230 |
| 2 | 16.9 | 12.9 | 2.4 | 1.06 | 0.60 | — | 0.021 | 0.17 | 155 |

2-mm mild steel canisters with a dimension of 92×26×150 mm were utilised. The interior of the 92×150 mm walls of the canisters were attached with 0.125 mm metal foils of Ti by spot-welding.

All canisters were filled with powder, evacuated and sealed according to standard procedure. Canisters with Ti-foil getter were treated according to the method described above. First, the heating was carried out rapidly up to 500° C., subsequently at a rate of 5° C./min up to a, in advance, chosen reduction temperature with a holding time of 60 minutes. Thereafter, the temperature was set to 900° C. and the environment outside the canisters was changed from hydrogen to argon. After 1 hour, the furnace heating was switched off and the canisters were allowed to cool down to room temperature inside the furnace. Subsequently, the powders were subjected to HIP. Table 2 illustrates the different compositions of metallic powder of the canisters and the parameters for which the canisters were subjected.

Slices with a thickness of 3 mm were cut out in the middle of the canisters through the small cross section (92×26 before HIP) and samples for chemical analysis were cut out from these slices. The foil-attached walls were not included in the samples. The results are also presented in Table 2, wherein the oxygen values represent the median of double samples, except for triple samples for Canister A.

TABLE 2

| Canister | A | B | C | D |
|---|---|---|---|---|
| Powder alloy | 1 | 1 | 2 | 2 |
| Selective hydrogen diffusion | Yes | Yes | Yes | No |
| Reduction temperature (° C.) | 1050 | 1080 | 1080 | — |
| HIP conditions (° C./MPa/min) | 1130/102/90 | 1150/100/120 | 1150/100/120 | 1150/100/120 |
| Oxygen (ppm) | 106 ± 5 | 64.5 ± 0.5 | 35.5 ± 0.5 | 183 ± 2 |

EXAMPLE 2

Two large canisters of 2 mm mild steel plate were produced with a diameter of 133 mm and a height of 206 mm. In this case, a 0.125 mm thick titanium foil and a 0.025 mm zirconium foil were attached to the inside of the envelope walls, respectively. The canisters were filled with Alloy 1 of Table 1, evacuated and sealed according to standard procedure. The canisters were subjected to the method described above with the following parameters: heating at 1.4° C./min in hydrogen up to 1100° C.; holding at 1100° C. during 9 hours; changing to argon flow and slow cooling down to room temperature (The cooling rate was 1.3-1.7° C./min down to 700° C.). Thereafter, HIP was performed at 1150° C. and 100 MPa during 3 hours.

Slices of 5 mm were cut out from the densified canisters approximately 4 cm from the top. Thereafter, eight double samples were cut out in the radial direction from the surface to the centre of the slices. The results, for the canister with Zr getter, are presented in Table 3 and the results, for the canister with Ti getter, are presented in Table 4. Sample 1 is closest to the surface and consequently, sample 8 is the centre. Furthermore, the oxygen distribution is shown in FIG. 1, wherein the dotted line illustrates the oxygen content of the powder before utilising the method.

TABLE 3

| Sample | 1 | 2 | 3 | 4 | 5 | 6 | 7 | 8 |
|---|---|---|---|---|---|---|---|---|
| O (ppm) | 30 | <10 | ~0 | ~0 | ~0 | 20 | 50 | 55 |
| N (wt %) | 0.30 | 0.29 | 0.28 | 0.28 | 0.28 | 0.28 | 0.28 | 0.28 |

TABLE 4

| Sample | 1 | 2 | 3 | 4 | 5 | 6 | 7 | 8 |
|---|---|---|---|---|---|---|---|---|
| O (ppm) | 16 | 17 | 25 | 38 | 55 | 65 | 115 | 130 |
| N (wt %) | 0.27 | 0.27 | 0.27 | 0.27 | 0.27 | 0.27 | 0.27 | 0.27 |

Apparently, the use of different getters results different oxygen distributions and overall oxygen reduction after the selective hydrogen diffusion procedure. Zr performed better than titanium with regard to overall oxygen reduction. However, there is an increase of oxygen close to the surface and in vicinity to the getter. This is believed to be a result of the surface attaining a lower temperature than the core during cooling, whereby a shift from reducing to oxidative condition appear in the cold regions.

Furthermore, the nitrogen content of the samples was analysed. The nitrogen loss was rather low and the Zr getter performed slightly better than the Ti getter. This is a result of the thin Zr-foil becoming saturated with nitrogen while continuating to reduce the oxygen content, i.e. act as a getter material.

EXAMPLE 3

The impact strength of the different specimens from Examples 1 and 2 was tested along with two comparative specimens where the method was not executed. Specimens of 10×10×55 were cut out from the produced test materials. From the canister of Example 2 with Zr-foil, specimens were cut out in the radial region having approximately zero ppm oxygen.

The specimens of Alloy 2 were annealed at 1050° C. for 60 minutes and then quenched in water. Specimens of Alloy 1 were annealed at 1080° C. for 60 minutes. Some of these specimens were quenched in water and others were cooled with controlled rate of 1-2.3° C./second through the temperature interval 900-700° C.

Notch cutting and Charpy notch impact test was performed. For the specimens of Alloy 2 the temperature of the impact tests was −196° C. and the temperature for Alloy 1 was −50° C. The results are presented in Table 5, wherein the Charpy notch impact energy is presented as an average of two specimens and Q stands for quenching and CCT stands for controlled cooling rate.

Clearly, Alloy 1 shows a transition from ductile to brittle at increasing oxygen content, similar to a transition with regard to temperature. The transition for quenched Alloy 1 is within the oxygen content interval 100-150 ppm.

The results show that the oxygen content should be reduced down to 100 ppm or less in order to obtain a ductile behaviour for Alloys 1 and 2.

TABLE 5

| Testmaterial | O (ppm) | Temp (° C.) | Cooling | Charpy notch impact energy (J) |
|---|---|---|---|---|
| Comparative (Alloy 1) | 237 | −50 | Q | 53 |
| Comparative (Alloy 1) | 227 | −50 | Q | 60 |
| Canister A of Example 1 (Alloy 1) | 106 | −50 | CCT | 144 |
| Canister A of Example 1 (Alloy 1) | 106 | −50 | Q | 279 |
| Canister B of Example 1 (Alloy 1) | 64.5 | −50 | CCT | 100 |
| Canister B of Example 1 (Alloy 1) | 64.5 | −50 | Q | 277 |
| Canister C of Example 1 (Alloy 2) | 35.5 | −196 | Q | 248 |
| Canister D of Example 1 (Alloy 2) | 183 | −196 | Q | 93 |
| Zr-getter of Example 2 (Alloy 1) | ~0 | −50 | CCT | 148 |
| Zr-getter of Example 2 (Alloy 1) | ~0 | −50 | Q | 276 |

The invention claimed is:

1. A method of producing a metal powder having controlled oxygen content comprising:

introducing a getter into a canister, introducing a metal powder into the canister, and then evacuating and sealing the canister, reducing the oxygen content in the metal powder by subjecting the canister to a heat treatment in an environment of gaseous hydrogen providing diffusion through the walls thereof until the hydrogen partial pressure on both sides of the walls of the canister is substantially equilibrated, and after the oxygen reduction in the metal powder subjecting the canister to an inert atmosphere or a vacuum so as to provide hydrogen diffusion out of the canister through the walls thereof.

2. Method according to claim 1 wherein the metal powder is a stainless steel.

3. Method according to claim 1 wherein the getter is selected from the group consisting of Ti, Zr, Hf, Ta, REM or an alloy or compound based on any of these elements.

4. The method according to claim 3, wherein the getter is Zr, Ti, or an alloy or compound thereof.

5. Method according to claim 1 wherein the step of subjecting the canister to the heat treatment in the hydrogen environment is performed at a temperature of about 900-1200° C.

6. The method according to claim 5, wherein the temperature is about 1000-1150° C.

7. Method according to claim 1 wherein the getter is homogeneously distributed along at least one wall of the canister, and wherein said wall has a length that is equal or longer than the other walls of the canister.

8. Method according to claim 7 wherein said wall has an area equal to or bigger than the other walls of the canister.

9. Method according to claim 1 comprising the step of introducing carbon into the metal powder.

10. Method of manufacturing a dense body by powder metallurgy techniques comprising the steps of subjecting a powder to the method according to claim 1 and thereafter densifying the powder.

11. Method according to claim 10 wherein the densifying step comprises a HIP or a CIP process and is performed in the canister.

* * * * *